US009050794B2

(12) United States Patent
Shirakawa et al.

(10) Patent No.: US 9,050,794 B2
(45) Date of Patent: Jun. 9, 2015

(54) PRINTING APPARATUS AND PRINTING METHOD

(71) Applicant: CANON KABUSHIKI KAISHA, Tokyo (JP)

(72) Inventors: Hiroaki Shirakawa, Kawasaki (JP); Kazuo Suzuki, Yokohama (JP); Mitsutoshi Nagamura, Tokyo (JP); Yuhei Oikawa, Yokohama (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/331,598

(22) Filed: Jul. 15, 2014

(65) Prior Publication Data

US 2015/0022574 A1 Jan. 22, 2015

(51) Int. Cl.
*B41J 2/07* (2006.01)

(52) U.S. Cl.
CPC ..... *B41J 2/07* (2013.01)

(58) Field of Classification Search
CPC ..... B41J 2/2107; B41J 2/2056; H04N 1/603; G06K 9/00; G06K 2209/01; G06K 9/346; G06K 9/50; G01R 33/5608
USPC ..... 347/9, 12, 14–15, 19, 43, 57
See application file for complete search history.

(56) References Cited

U.S. PATENT DOCUMENTS 5,896,464 A * 4/1999 Horiuchi et al. ..... 382/178
6,643,031 B1 * 11/2003 Takano et al. ..... 358/1.9
7,102,786 B2 * 9/2006 Takahashi et al. ..... 358/1.9

FOREIGN PATENT DOCUMENTS

JP 2008-55855 A 3/2008

* cited by examiner

*Primary Examiner* — Thinh Nguyen
(74) *Attorney, Agent, or Firm* — Canon USA Inc IP Division

(57) ABSTRACT

An inkjet printing apparatus which performs printing by performing scanning using a print head has a problem in that quality of an image of a ruled line is degraded when ink is not ejected for a certain period of time. To address this problem, control is performed such that power for driving the print head for unit regions including pixels having a ruled-line attribute becomes higher than power for driving the print head for unit regions which do not include the pixels having the ruled-line attribute. By this, a high-quality ruled-line image may be printed.

10 Claims, 11 Drawing Sheets

| | | | | | | | | | | | | | | | | | |
|---|---|---|---|---|---|---|---|---|---|---|---|---|---|---|---|---|---|
| 15 | 90 | 90 | 80 | 90 | 90 | 85 | 85 | 85 | 80 | 80 | 75 | 95 | 85 | 90 | 90 | 0 | 9 → 900 | 0 |
| 5 | 25 | 30 | 30 | 29 | 26 | 20 | 25 | 20 | 21 | 22 | 22 | 20 | 21 | 25 | 20 | 0 | 10 → 1000 | 0 |
| 15 | 90 | 90 | 80 | 90 | 85 | 80 | 85 | 85 | 85 | 80 | 80 | 90 | 90 | 90 | 80 | 0 | 9 → 900 | 0 |

| | | | | | | | | | | | | | | | | | | |
|---|---|---|---|---|---|---|---|---|---|---|---|---|---|---|---|---|---|---|
| 15 → 0 | 90 → 0 | 90 → 0 | 80 → 0 | 90 → 0 | 90 → 0 | 85 → 0 | 85 → 0 | 85 → 0 | 80 → 0 | 80 → 0 | 75 → 0 | 95 → 0 | 85 → 0 | 90 → 0 | 90 → 0 | 0 | 9 | 0 |
| 5 → 0 | 25 → 0 | 30 → 0 | 30 → 0 | 29 → 0 | 26 → 0 | 20 → 0 | 25 → 0 | 20 → 0 | 21 → 0 | 22 → 0 | 22 → 0 | 20 → 0 | 21 → 0 | 25 → 0 | 20 → 0 | 0 | 10 | 0 |
| 15 → 0 | 90 → 0 | 90 → 0 | 80 → 0 | 90 → 0 | 85 → 0 | 80 → 0 | 85 → 0 | 85 → 0 | 85 → 0 | 80 → 0 | 80 → 0 | 90 → 0 | 90 → 0 | 90 → 0 | 80 → 0 | 0 | 9 | 0 |

PRINTING APPARATUS AND PRINTING METHOD

BACKGROUND

1. Technical Field

The present disclosure relates to a printing apparatus which prints an image on a printing medium using a print head including printing elements which eject ink and a printing method.

2. Description of the Related Art

Printing apparatuses form an image by ejecting ink from a plurality of nozzles disposed in a print head. The ink is formed by color material, organic solvent, water, and the like, and a component ratio of the water is particularly high. The water easily evaporates from ejection ports (nozzles) of the print head; and therefore, if ink ejection is not performed for a certain period of time, the color material and the organic solvent of the ink in portions in the vicinity of the ejection ports are condensed. Such condensation of ink prevents the ink from being normally ejected from the ejection ports. For example, the condensation of ink causes deterioration of landing accuracy of ink droplets on a printing medium and miniaturization of ink droplets.

To suppress such disadvantages, preliminary ejection is generally performed before scanning is performed using a print head so that ink condensation is cleared. However, if a blank region (non-image region) having a certain size or larger than the certain size is detected during scanning, the ink condensation progresses in the vicinity of ejection ports during scanning of the blank region; and accordingly, there arises a problem in that ink is not normally ejected at an ejection timing after the blank region is scanned.

To address the problem, Japanese Patent Laid-Open No. 2008-55855 discloses as follows: Change from a region which does not include an image having a certain size or larger than the certain size to a region which includes an image having the certain size or larger than the certain size in a printed image is detected. Thereafter, power for driving a print head for the region which includes the image and which positions after the region which does not include the image in a scanning direction is increased so that the increased power is larger than a regular power. The change from the non-image region to the image-including region is realized by dividing an image region into unit regions corresponding to a plurality of nozzles and counting the number of print dots in the individual unit regions. Japanese Patent Laid-Open No. 2008-55855 discloses determinations of non-image regions and image-including regions by comparing a count value with a predetermined threshold value and change of power at a time when a certain number or more of non-image regions are consecutively detected. By this method, even when ink is condensed in the ejection ports, a sufficient speed of ejection of ink droplets may be maintained, and accordingly, the image degradation described above may be suppressed.

SUMMARY

However, since a change from a region which does not include an image, that is, a blank region, to a region which includes an image is detected in the method disclosed in Japanese Patent Laid-Open No. 2008-55855, when the number of ink droplets ejected to a region is small, the region may be determined to be a non-image region. Accordingly, even when a region including an image is scanned, power may not be increased. A case where a certain number of regions on which ink is not to be ejected are consecutively detected in a scanning direction of a print head; and therefore, ink is condensed in portions in the vicinity of ejection ports, and furthermore, a region only including a thin ruled line extending in a direction (vertical direction) orthogonal to the scanning direction is to be printed is taken as an example of the case described above. In this case, power for driving printing elements of the print head is to be increased to print the vertical ruled line. However, when a dot count value of a region including the vertical ruled line is smaller than a predetermined threshold value, it is determined that the region does not include an image, and therefore, the power for driving the printing elements is not controlled to be increased to print the vertical ruled line. Therefore, defective ejection and degradation of droplet landing accuracy occur, due to ink condensation, which cause variation of a width of the vertical ruled line and degradation of density of the vertical ruled line. Accordingly, a high-quality image including a ruled line and a thin line may not be printed.

The present disclosure provides a printing apparatus for printing an image on a printing medium using a plurality of printing elements for generating energy used for ejection of ink. The printing apparatus includes a determination unit configured to determine whether a pixel having a ruled-line attribute is included in image data of the image and a printing unit configured to print the image based on a result of the determination performed by the determination unit, wherein the energy to be applied by the printing elements to the ink for printing a region including the pixel having the ruled-line attribute is higher than energy to be applied by the printing elements to the ink for printing a region which does not include the pixel having the ruled-line attribute.

Further features of the present invention will become apparent from the following description of exemplary embodiments with reference to the attached drawings.

With this configuration, even in an image in which a setting of an appropriate threshold value for dot count values is difficult, such as an image including a thin line or a ruled line, power for driving printing elements of a print head may be appropriately controlled.

DESCRIPTION OF THE EMBODIMENTS

First Embodiment

Figure 1A:
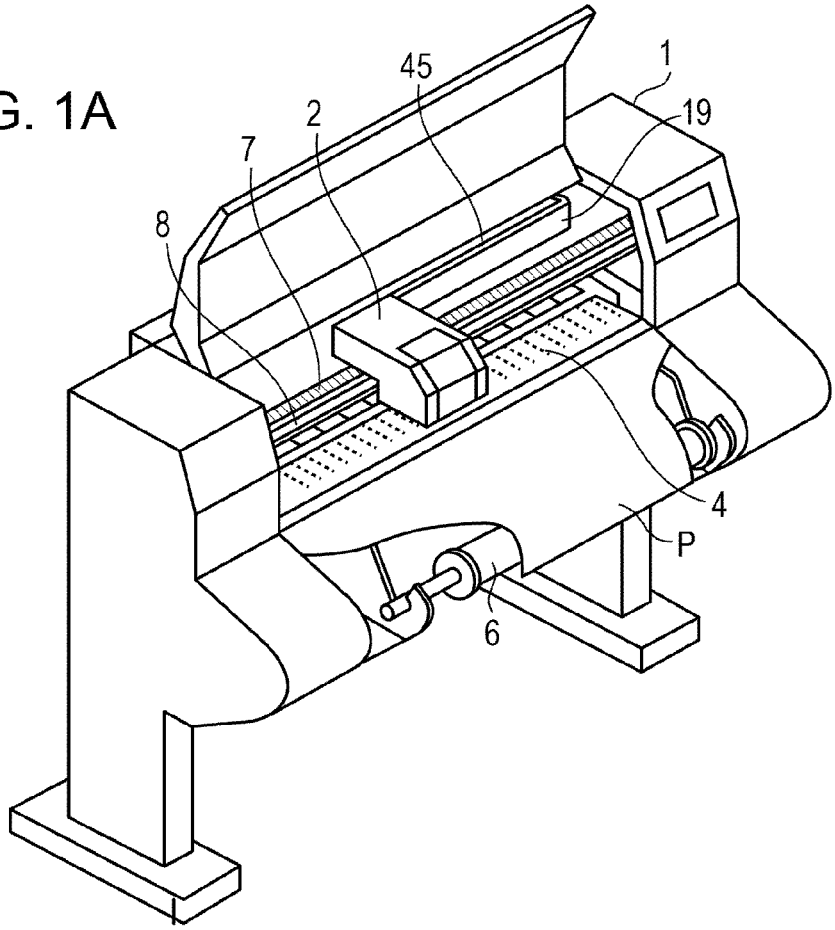
FIGS. 1A and 1B are diagrams schematically illustrating inkjet printing apparatuses.

FIG. 1A is a diagram schematically illustrating an inkjet printing apparatus (hereinafter also referred to as a "printer") according to a first embodiment. A printer 1 is a so-called serial scan printer which forms an image by performing scanning (main scanning) using a print head in a direction (a main scanning direction) orthogonal to a conveyance direction (a sub-scanning direction) of a printing medium P.

Next, a configuration of the printer 1 and operation of the printer 1 at a time of printing are briefly described. First, a feed roller (not illustrated) is driven through a gear by a feed motor (not illustrated) so as to feed the printing medium P supported by a spool 6. Meanwhile, a carriage motor (not illustrated) causes a carriage unit 2 to perform scanning in a certain conveyance position along a guide shaft 8 extending in the main scanning direction. A print head 9 is detachably attached to the carriage unit 2. At a timing based on a positional signal obtained by an encoder 7, ink droplets are ejected from ejection ports (nozzles) disposed in the print head 9 during the scanning using the carriage unit 2 so that an image is printed in a region having a certain bandwidth corresponding to a nozzle alignment range. Thereafter, the printing medium P is conveyed and an image is printed in a next region having the bandwidth. Note that, between scanning operations, the printing medium P may be conveyed by a width corresponding to the nozzle alignment range or by an amount smaller than the width corresponding to the nozzle alignment range. Furthermore, so-called multi-pass printing in which data extracted by predetermined masking by one scanning is printed, and thereafter, the printing medium P is conveyed by an amount smaller than the nozzle alignment range, and an image is formed by performing a plurality of scanning operations on the same region may be performed. Furthermore, a printing medium may not be conveyed every time scanning is performed but may be conveyed after a plurality of scanning operations.

The print head 9 has printing elements for ejecting ink and a flexible wiring board which supplies a signal pulse for driving the printing elements and a head temperature adjustment signal. The other terminal of the flexible wiring board is connected to a control circuit which controls the printer 1.

In this embodiment, a carriage belt is used to transmit driving force from a carriage motor to the carriage unit 2. Other driving methods may be used instead of the method using the carriage belt, such as a method using an element including a lead screw which is driven to rotate by the carriage motor and which extends in the main scanning direction and an engaging portion which is disposed in the carriage unit 2 and which is engaged with a groove of the lead screw.

The fed printing medium P is pinched and conveyed by the feed roller and a pinch roller, not illustrated, so as to be guided to a printing position (a region subjected to main scanning performed by the print head 9) on a platen 4. In a state in which printing is not performed, an ejection-port surface of the print head 9 is covered by a cap member. When an instruction for printing an image is received, the cap member is removed before the printing so that the print head 9 and the carriage unit 2 become available for scanning. When data for one scanning is stored in a buffer, the carriage motor causes the carriage unit 2 to perform scanning so that an image is printed on a printing medium.

Figure 1B:
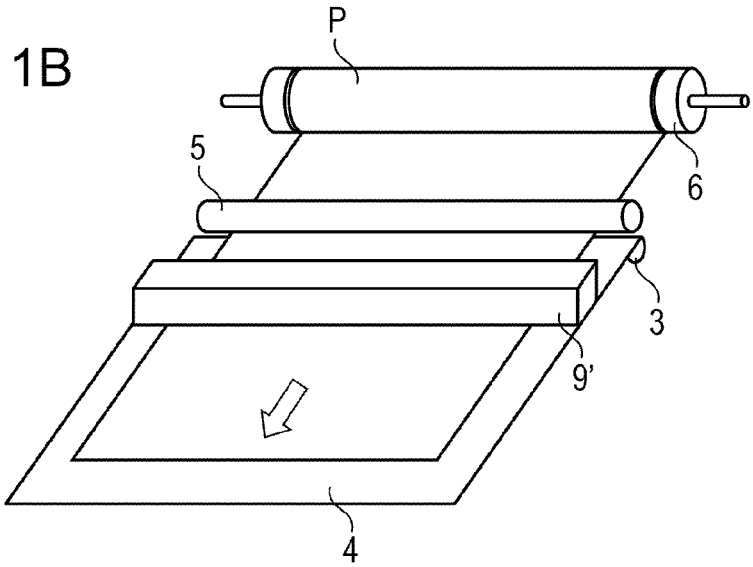

FIG. 1B is a diagram illustrating an example of another inkjet printing apparatus. The inkjet printing apparatus is a so-called full-multi printer which includes a print head 9' having a length equal to or larger than a width of the printing medium P in a direction orthogonal to a conveyance direction (a direction of an arrow in FIG. 1B) of the printing medium P. An image is printed on the printing medium P while the printing medium P is conveyed in the conveyance direction. Specifically, the rolled printing medium P is held by the spool 6, and pinched and conveyed by a feed roller 3 and a pinch roller 5. The conveyed printing medium P is guided to a platen 4 at a constant speed. In a direction orthogonal to the conveyance direction, a width of the print head 9' is larger than the width of the printing medium P. The printing medium P passes the print head 9' at the constant speed in the conveyance direction, and ink droplets are ejected from ejection ports disposed in the print head 9' with certain resolution while the printing medium P passes the print head 9' so that an image is printed.

Figure 2A:
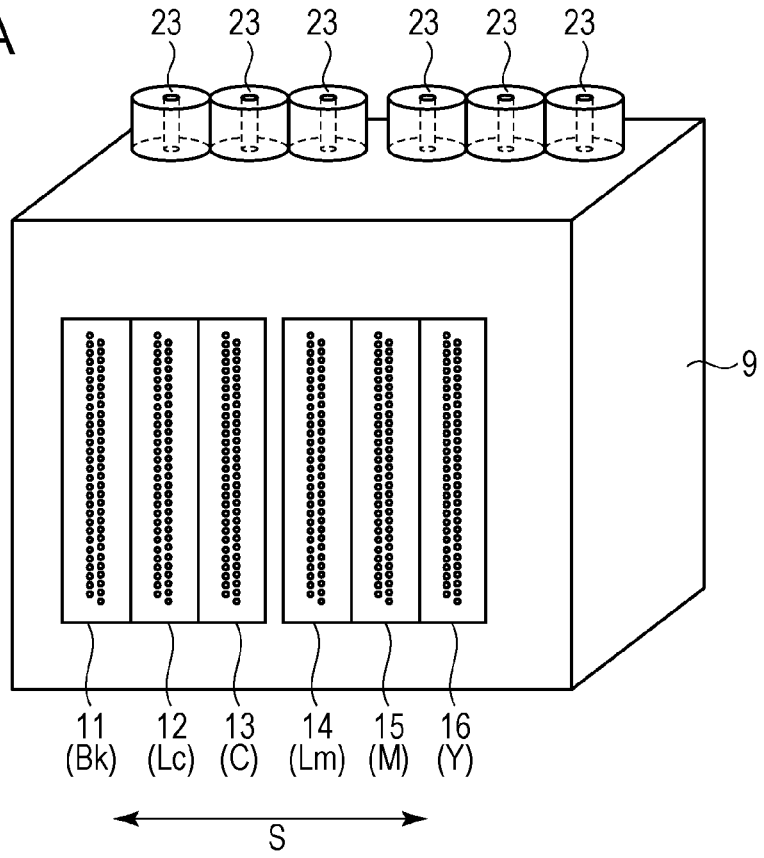
FIGS. 2A and 2B are diagrams schematically illustrating a print head which ejects ink.
Figure 2B:
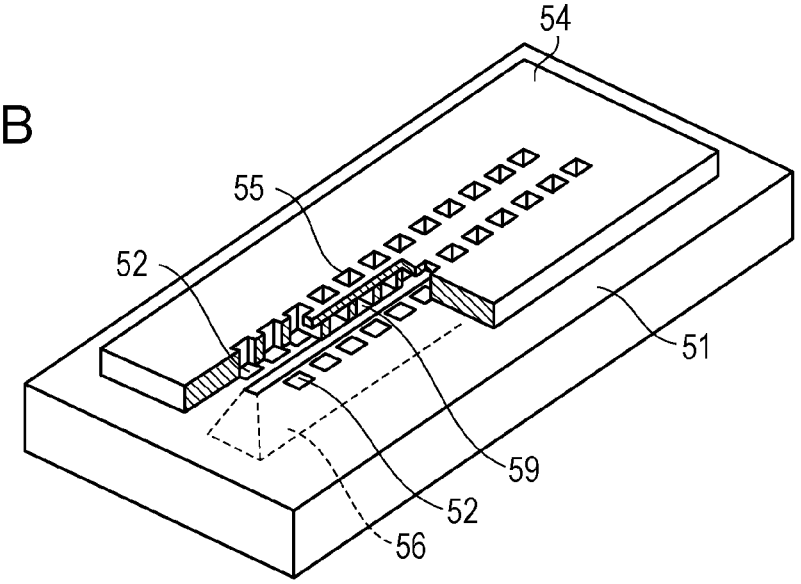

FIGS. 2A and 2B are diagrams illustrating the print head 9 disposed on the carriage unit 2 of the printer 1. FIG. 2A is a diagram schematically illustrating the print head 9 viewed from a direction in which ink is ejected. The print head 9 has ejection portions 11 to 16 which are capable of ejecting inks of different color tones (including colors and color density) and which are disposed along the main scanning direction (an S direction in FIG. 2A). In this embodiment, inks of six colors including black (Bk), light cyan (Lc), cyan (C), light magenta (Lm), magenta (M), and yellow (Y) are used. The inks are supplied from ink introduction portions 23 through ink flow paths included in the print head 9 to the ejection portions 11 to 16. The inks are introduced to the ink introduction portions 23 using tubes from ink tanks. When the full-multi printer is used, the print head 9' may have a plurality of print heads 9 illustrated in FIG. 2A aligned in a direction in which nozzles are aligned, or may have a plurality of ejection portions aligned in a direction of a nozzle line.

FIG. 2B is a diagram schematically illustrating the ejection portion 11 which ejects a black ink, and the ejection portions 12 to 16 which eject the other inks have the same configuration. The ejection portion 11 includes heating portions 52 serving as printing elements, and ejects ink using thermal energy which causes film boiling of the ink when current is applied. The heating portions 52 are formed on a substrate 51 in two lines at a certain pitch. Furthermore, an ink supply port 56 which communicates with a corresponding one of the ink flow paths is disposed between the two heating portion lines on the substrate 51. The ejection portion 11 is configured such that a member (orifice plate) 54 including nozzles (ejection ports) 55 corresponding to the heating portions 52 and ink paths 59 which supply ink from the ink supply port 56 and which correspond to the nozzles 55 formed thereon is bonded to the substrate 51.

Since the heating portions 52 and the nozzles 55 in one of the lines are shifted from those in the other of the lines by half pitch, desired print resolution is realized. Furthermore, the ejection portions 11 to 16 may have the same print density and the same number of nozzles or different print densities and the different numbers of nozzles. In this embodiment, 1280 nozzles are arranged in each of the ejection portions 11 to 16 with a density of 490 nozzles for 1 cm. Furthermore, although the ejection portions 11 to 16 employing the method for ejecting the inks by the heating portions 52 in a vertical direction relative to the substrate 51 is used in this embodiment, ejection portions employing a method for ejecting inks in a horizontal direction may be used.

Figure 3:
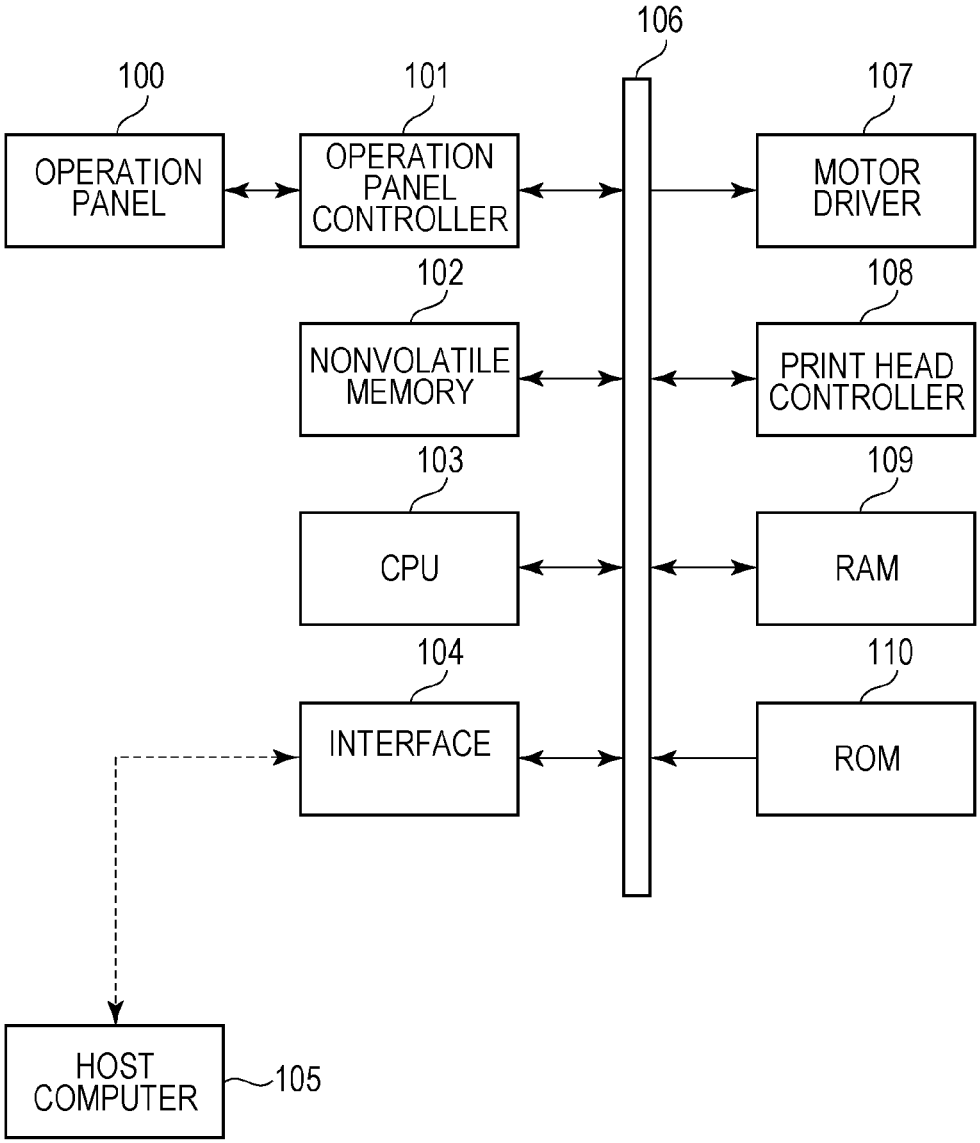
FIG. 3 is a block diagram illustrating an electric configuration of the inkjet printing apparatus.

FIG. 3 is a block diagram illustrating an electrical configuration of the printer 1 according to this embodiment. An operation panel 100 of FIG. 3 has operation keys and a display panel disposed thereon. An operation panel controller 101 monitors states of the keys disposed on the operation panel 100 and issues an appropriate control command in response to press of one of the keys to a printer control circuit including a CPU 103. Furthermore, the operation panel controller 101 generates a character string to be displayed in the display panel and controls the display panel. The user may input an instruction for specifying an operation of the printer 1, such as start of a process of recovery from an error generation state, by performing key input using the keys disposed on the display panel. An interface 104 used to connect the printer 1 and a host computer 105 to each other receives data from the host computer 105 and transmits a status, and the like. That is, the interface 104 functions as a data transmission/reception communication port for communication with the host computer 105.

A bus 106 has a function of connecting the CPU 103 to the other devices. A nonvolatile memory 102 is a recording device which stores and records various types of information and capable of maintaining recorded information even when power supply is stopped. A motor driver 107 is a control circuit which controls motors including a carriage motor, the feed motor, and a recovery motor which are used for a printing operation performed by the inkjet printing apparatus. The carriage motor activates the print head 9 and the feed motor conveys a printing medium so as to supply and eject the printing medium. The recovery motor activates a cleaning mechanism and the cap.

A RAM (Random Access Memory) 109 is a recording device which stores information only while power is supplied. When power supply is stopped, information stored in the RAM 109 is removed. A ROM (Read Only Memory) 110 is a readable recording device which records control programs of the printer 1 which are referred to by the CPU 103 for control operation.

Hereinafter, an operation state of the circuit will be described. The CPU 103 reads the control programs from the ROM 110 and executes control of the various devices in accordance with the control programs. The interface 104 receives print data from the host computer 105 and writes the print data in the RAM 109, and the CPU 103 controls the motor driver 107 and a print head controller 108 in accordance with the written data. The print head controller 108 drives the heating portions 52 of the print head 9 under control of the CPU 103 so that ink droplets are ejected. When a replacement print head is used, heads have unique head IDs and a determination as to whether a head has been replaced is made by comparing IDs of heads. Furthermore, individual variability of print heads including a head rank (an amount of heating of head-internal members), a correction value of a temperature sensor (a correction value for variation of a sensor indicating a temperature inside a head), and the like is checked when the printer 1 is initially operated.

Figure 4:
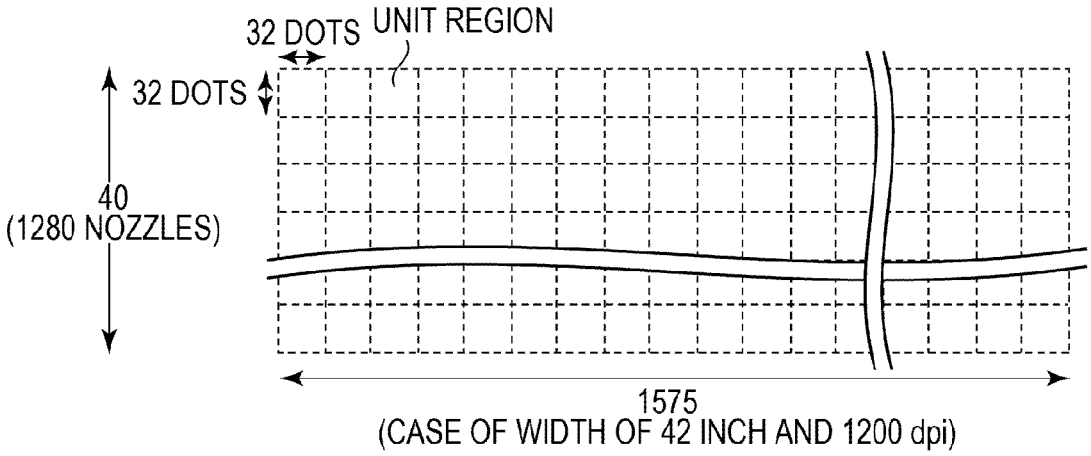
FIG. 4 is a diagram illustrating the relationship between image data for one scan and unit regions.

FIG. 4 is a diagram illustrating image data printed by one scanning operation performed by the print head 9 and unit regions. Each of the unit regions is defined by 32 dots in the scanning direction of the print head 9 and 32 dots in an alignment direction of the nozzles. Since 1280 nozzles are used for each color in the print head 9 of this embodiment, 40 unit regions are aligned in a direction in which the nozzles are aligned in image data for one scanning operation. Assuming that a width of the image data is 42 inch and print resolution is 1200 dpi, 1575 unit regions are aligned in a direction in which the print head 9 performs scanning. Print density of image data for one scanning operation may be calculated by obtaining count numbers which are values obtained by counting print dots of the individual colors for individual unit regions. By this, a position in which a non-image region is changed to an image-including region may be detected in accordance with the count values. The count of the print dots is performed when the image data is converted into binary data for individual ink colors.

Figure 5A:
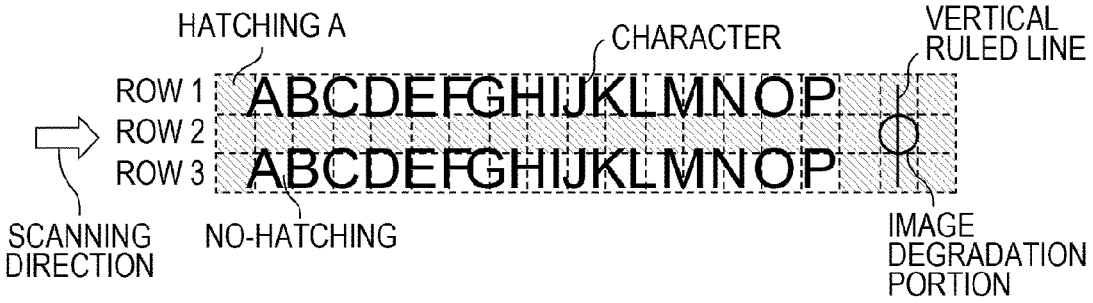
FIGS. 5A and 5B are diagrams illustrating methods for setting a position in which driving power is to be changed in the related arts.

FIG. 5A is a diagram illustrating an image including alphabets and a vertical ruled line. In FIG. 5A, the alphabets are arranged in two rows, that is, first and third rows, and the vertical ruled line is arranged after the alphabets in a scanning direction. A nozzle group corresponding to a second row disposed between the first and third rows does not eject ink until the vertical ruled line is reached, and therefore, condensation of ink progresses in the portions in the vicinity of the ejection ports. Accordingly, it is likely that a portion of the vertical ruled line corresponding to a portion to be printed by nozzles in which ink is condensed in the portions in the vicinity of the ejection ports is not normally printed.

It is possible that, when the method for determining a non-image region and an image-including region using a predetermined threshold value and changing driving power of a print head in a changing position disclosed in Japanese Patent Laid-Open No. 2008-55855 is employed, count values in unit regions including the vertical ruled line become smaller than the threshold value. In FIG. 5A, unit regions having count values smaller than a predetermined threshold value are denoted by hatching A whereas unit regions having count values equal to or larger than the threshold value are not hatched. In FIG. 5A, count values of the unit regions including the vertical ruled line are smaller than the threshold value.

Figure 5B:
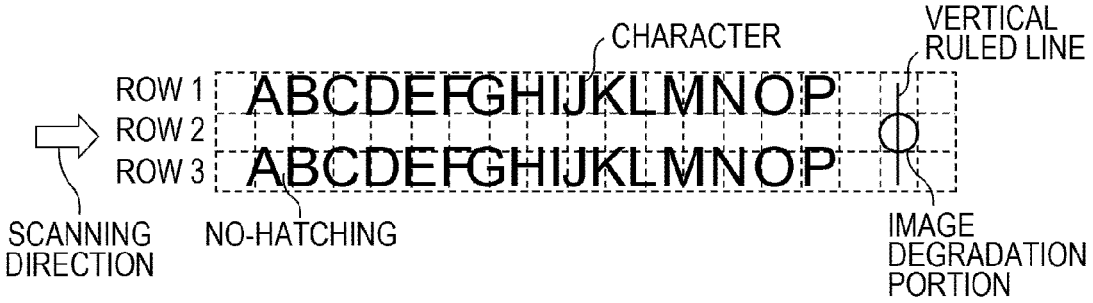

On the other hand, in FIG. 5B, a threshold value is set such that the dot count values of the unit regions including the vertical ruled line become equal to or larger than the threshold value so that the vertical ruled line is recognized as an image-including region in the same image as FIG. 5A. In this case, since count values of the unit regions corresponding to a space between the lines in the second row also become equal to or larger than the threshold value, all the unit regions which are not hatched correspond to regions having count values equal to or larger than the threshold value. Also in this case, it is possible that the vertical ruled line is not detected as a position of changing from the non-image region to the image-including region, and therefore, the vertical ruled line is not normally printed. It is appreciated that a horizontal ruled line may be similarly degraded in terms of quality.

To address the problem described above, in this embodiment, attribute data representing properties of pixels is obtained and driving power of the print head 9 is controlled such that the driving power for unit regions including pixels having an attribute of the ruled line becomes higher than regular power so that degradation of quality of the ruled line is suppressed.

Figure 6:
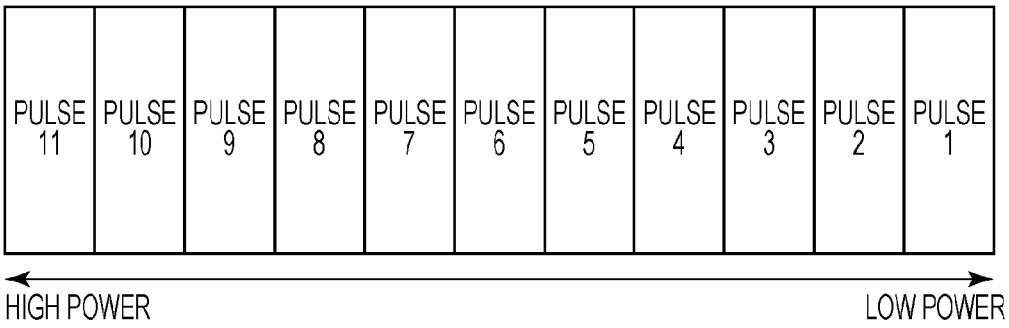
FIG. 6 is a diagram illustrating a driving pulse table of the print head.

FIG. 6 is a diagram illustrating driving pulses to be applied to the print head 9 of this embodiment. The inkjet printing apparatus of this embodiment has a driving pulse table including 11 types of driving pulse of different driving powers of the print head 9. The print head 9 of this embodiment uses thermal energy which causes film-boiling of ink when current is supplied to the heating portions 52 serving as the printing elements, and controls driving power by controlling the energy generated by the heating portions 52. In this embodiment, as a method for generating energy to be applied by the heating portions 52 to the ink so that ink droplets are ejected, a main heating pulse and a pre-heating pulse are applied to the heating portions 52. Then energy to be applied by the heating portions 52 to the ink is controlled by controlling a period of time in which the pre-heating pulse is applied. Note that a temperature of the print head 9 is detected, and the 11 types of driving pulses are associated with temperatures of the print head 9 so that driving power becomes large as a detected head temperature becomes low. As illustrated in FIG. 6, in driving pulses 1 to 11, the larger a number of the reference numeral is, the larger driving power is and the higher the speed of ejection of ink droplets is.

In normal driving pulse control in this embodiment, the head temperature is obtained immediately before printing is started or at an arbitrary timing during printing, and one of the driving pulses 1 to 11 which corresponds to the obtained head temperature is selected from the driving pulse table. A driving pulse having the highest driving power (the driving pulse 11 in FIG. 6) among the 11 types of driving pulse is selected for unit regions including pixels having a ruled-line attribute irrespective of the head temperature. Specifically, a period of time in which the pre-heating pulse is applied is longer than a period of time in which the driving pulse is applied to the unit regions which do not include the pixels having the ruled-line attribute. By this, even in a state in which ink is condensed in the portions in the vicinity of the ejection ports, a sufficient ejection speed of ink droplets ejected by increasing the driving power is maintained, and accordingly, degradation of quality of the ruled line may be suppressed. When a pulse is to be changed to the driving pulse 11, the pulse may be changed from a driving pulse corresponding to the head temperature in levels or may be changed in a printing start position of a unit region including the pixels having the ruled-line attribute. When the pulse is changed in levels, the change is preferably started beforehand so that the driving pulse 11 is selected in the printing start position of the unit region including the pixels having the ruled-line attribute.

The attribute data representing properties of pixels of image data is stored in parallel to color information of the pixels. While image processing and binarization processing are executed on an ASIC (Application Specific Integrated Circuit) of the inkjet printing apparatus after image data is received from the host computer 105, the attribute information is stored for each pixel. Examples of an image attribute include a character attribute, a ruled-line attribute, a graphic attribute, and a pure black attribute.

Figure 7:
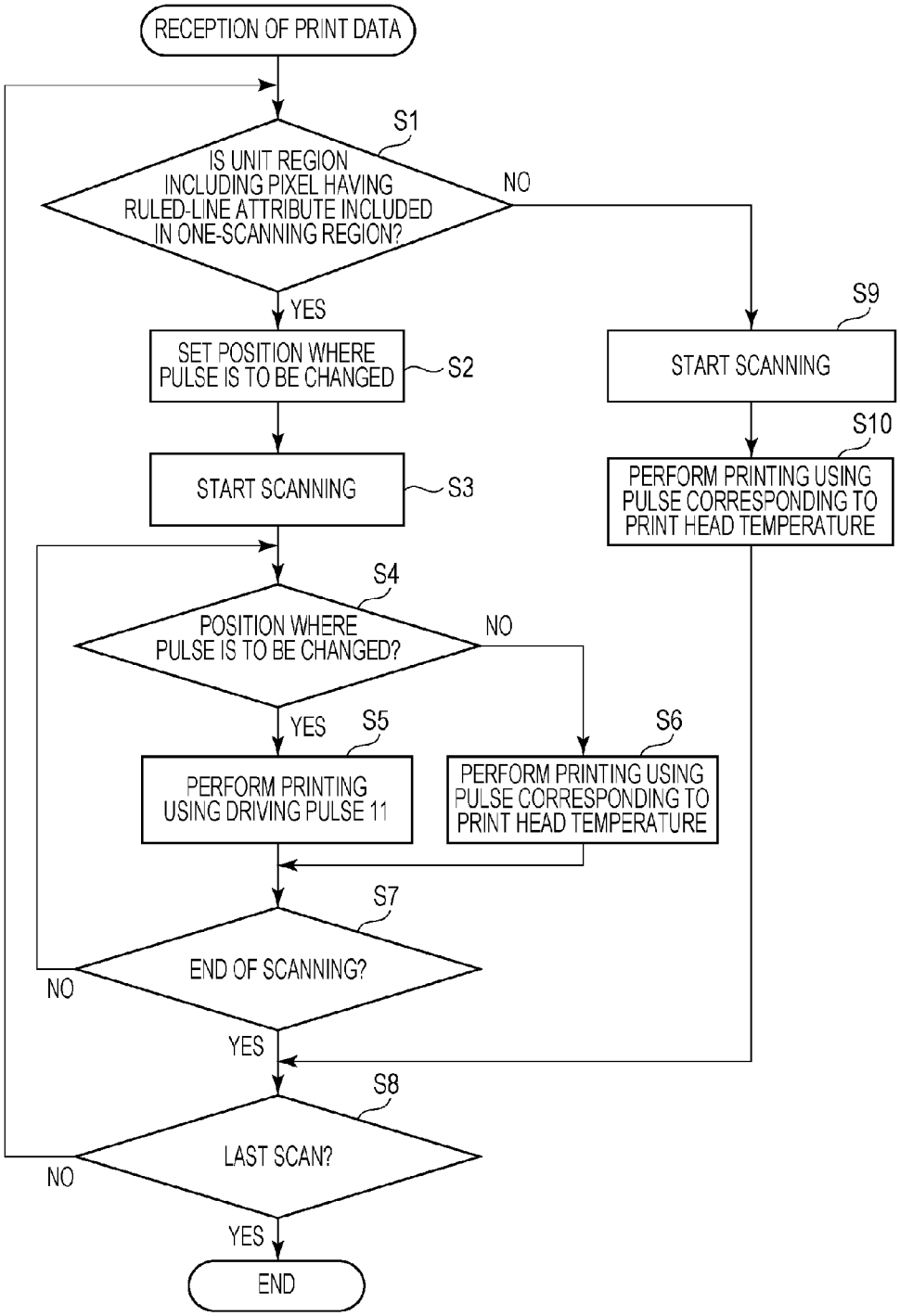
FIG. 7 is a flowchart illustrating a method for changing a driving pulse according to a first embodiment.

A driving pulse changing method will be described with reference to a flowchart illustrated in FIG. 7. In this embodiment, a program recorded in the ROM 110 is read and temporarily stored in the RAM 109 and is executed by the CPU 103. When print data is received, image data to be scanned is divided into unit regions before scanning is started. A determination as to whether the pixels having the ruled-line attribute are included is made on all unit regions included in a region printed by one scanning operation in accordance with the attribute information stored for individual pixels (step S1). When at least one of the unit regions includes the pixels having the ruled-line attribute, the process proceeds to step S2. Then unit regions which align in the scanning direction of the print head 9 (a vertical direction of FIG. 4) are determined as a unit region group, and a determination as to whether the pixels having the ruled-line attribute are included in a unit region is made for each unit region group. In this embodiment, each unit region group includes 40 unit regions. When at least one of the unit regions includes the pixels having the ruled-line attribute as a result of the determination, a position where the driving pulse is to be changed is set in advance so that the driving pulse is changed at the printing start position of the unit region group (in step S2). When the setting is completed, the print head 9 is driven to start scanning (in step S3), and prints an image while a determination as to whether the position where the driving pulse to be applied to the print head is to be changed is detected at all time (in step S4). When the position where the driving pulse is to be changed is reached, the driving pulse 11 is changed from a unit region group to be printed next (in step S5). When the pulse is to be changed in levels, the pulse is changed in an appropriate position before the position where the driving pulse is to be changed. When it is determined that the position where the driving pulse is to be changed has not been reached in step S4, a driving pulse corresponding to a temperature of the print head 9 is used. The driving pulse which is used before the changing is used again for a unit region group to be printed immediately after the unit region printed after the driving pulse is changed. This printing operation is repeatedly performed until the scanning is terminated. When the scanning is to be terminated, it is determined whether the last scanning operation is reached (in step S7). When it is determined that the last scanning operation has not been reached, the process returns to step S1 and the next scanning operation is started. When it is determined that any of the unit regions does not include the pixels having the ruled-line attribute in step S1, scanning is started (in step S9), and thereafter, an image is printed by a driving pulse corresponding to a temperature of the print head 9 (in step S10).

As described above, since the driving pulse is changed by determining whether a unit region including the pixels having the ruled-line attribute is detected, degradation of quality of the ruled line caused by defective ejection owing to condensation of ink in the portions in the vicinity of the ejection ports may be suppressed.

Although the determination as to whether the pixels having the ruled-line attribute are included is made for each unit region group in this embodiment in the nozzle alignment direction, the determination may be made for each unit region when a print head capable of changing a driving pulse for each unit region is used. Furthermore, as long as a driving pulse for a region including the pixels having the ruled-line attribute may increase energy to be applied to ink when compared with a driving pulse for regions which do not include the pixels having the ruled-line attribute, other methods than the method for increasing a period of time in which the pre-heating pulse is applied may be used. This is because, when the energy to be applied to ink is increased, a speed of ejection of ink may be enhanced. For example, a method for lowering a driving voltage for the unit region group including the pixels having the ruled-line attribute relative to a driving voltage for the driving pulse for the unit region group which does not include the pixels having the ruled-line attribute may be employed. This is because, when a driving voltage is high, film-boiling occurs when volumes of inks which are sufficiently heated in the portions in the vicinity of the heating portions are still small, and therefore, ink droplets are ejected. On the other hand, when a driving voltage is low, film-boiling occurs when volumes of inks which are sufficiently heated in the portions in the vicinity of the heating portions are large, and therefore, even ink which has high viscosity since moisture is evaporated may be easily ejected. Note that a period of time in which a driving pulse is applied to the unit region group including the pixels having the ruled-line attribute may be set longer than a period of time in which a driving pulse is applied to a unit region group which does not include the pixels having the ruled-line attribute. Furthermore, to suppress the defective ejection caused by condensation of ink, any method other than the method for changing energy of a driving pulse to be applied to the heating portions may be employed as long as a temperature of ink included in the nozzles is increased at a timing when the main heating pulse is applied so that viscosity is lowered. For example, when a halt time between the main heating pulse and the pre-heating pulse is increased, volumes of heated inks are increased, and therefore, defective ejection may be addressed. Accordingly, a halt time for a driving pulse for the unit region group including the pixels having the ruled-line attribute is set longer than a halt time for a driving pulse for the unit region group which does not include the pixels having the ruled-line attribute.

Although the serial scanning printer illustrated in FIG. 1A is employed in this embodiment, the full-multi printer illustrated in FIG. 1B may be employed. When the full-multi printer is employed, the method described above is employed for each conveyance of a printing medium instead of one scanning operation of the print head 9. Furthermore, the scanning direction of the print head 9 in FIGS. 5A and 5B corresponds to a direction in which the printing medium is conveyed.

Second Embodiment

In the first embodiment, the driving power for the printing elements is controlled as a result of a determination as to whether the pixels having the ruled-line attribute are included. However, in a second embodiment, driving power for printing elements is controlled in accordance with count values of print dots.

Figure 8:
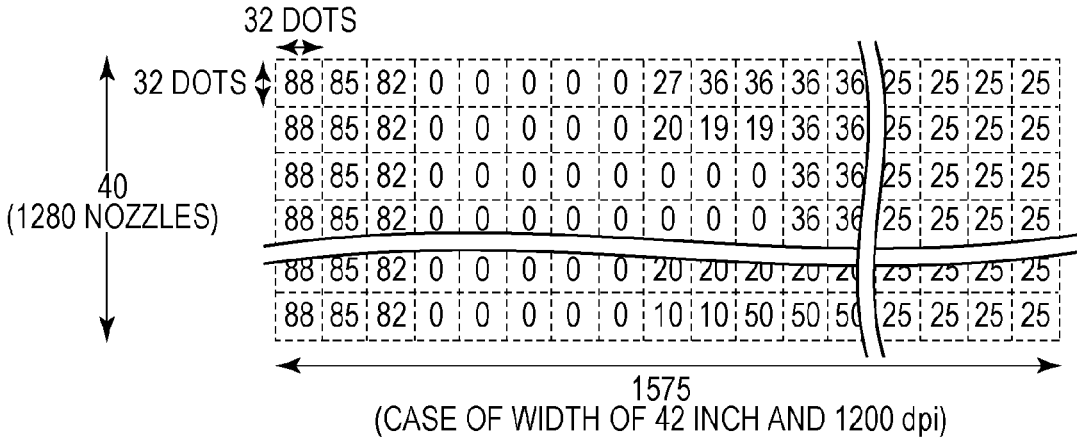
FIG. 8 is a diagram illustrating a dot count method according to a second embodiment.

FIG. 8 is a diagram illustrating a method for counting print dots. Numbers illustrated in unit regions represent count values obtained by counting the numbers of ink droplets (print dots) to be ejected to the unit regions. Ink is not ejected to unit regions corresponding to a count value of zero. In this embodiment, before the numbers of print dots are counted, a weighting process is performed in accordance with properties of the pixels.

Figure 9:
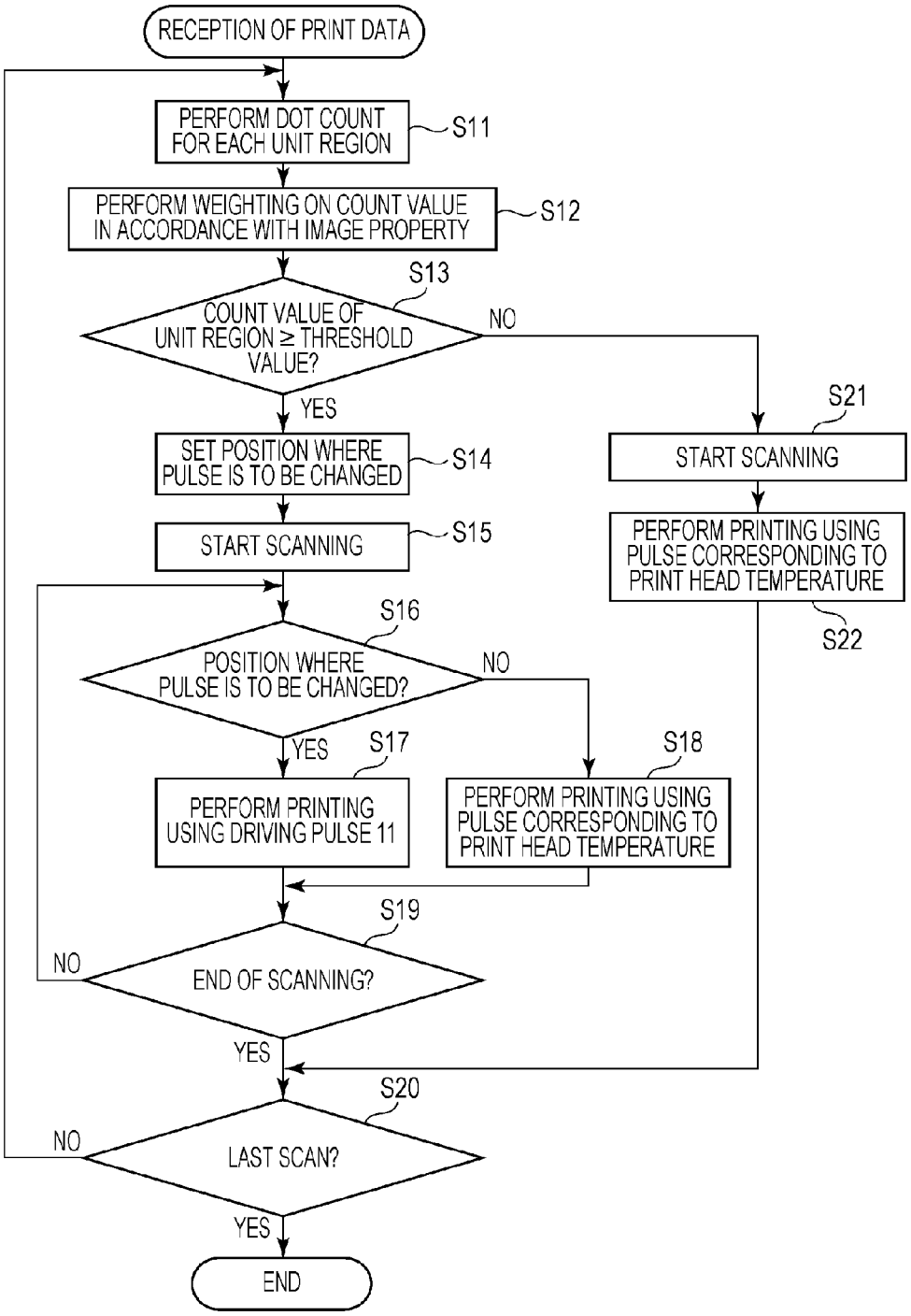
FIG. 9 is a flowchart illustrating a method for changing a driving pulse according to the second embodiment.

FIG. 9 is a flowchart illustrating a dot count process and a process of changing a driving pulse during printing according to this embodiment. A serial scanning printer is taken as an example. First, when print data is received, image data to be scanned is divided into unit regions before scanning is started and numbers of print dots to be printed are counted for individual unit regions (in step S11). Thereafter, a weighting process is performed on count values obtained by the counting performed in step S11 in accordance with attribute information of individual pixels of image data (in step S12). Subsequently, a determination as to whether a unit region having a count value equal to or larger than a threshold value is included is made for individual unit region groups (in step S13). As a result of the determination, when at least one unit region having a count value equal to or larger than the threshold value is included, a position where the driving pulse is to be changed is set in advance so that the driving pulse is changed at a printing start position in the unit region group (in step S14). A process from step S15 to step S22 is the same as the process from step S3 to step S10 of the first embodiment, and therefore, a description of the process is omitted.

Figures 10A, 10B, 10C:
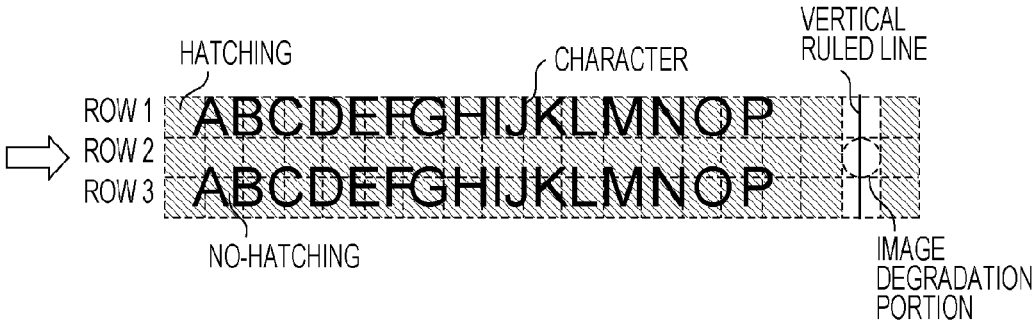
FIGS. 10A to 10C are diagrams illustrating a process of weighting count values according to the second embodiment.

FIGS. 10A to 10C are diagrams illustrating the count-value weighting process performed in step S12. As with the image illustrated in FIGS. 5A and 5B, an image illustrated in FIG. 10A includes alphabets and a vertical ruled line. FIG. 10B is a diagram illustrating count values of print dots to be printed in the unit regions. Here, assuming that 50 is set as a threshold value, count values of unit regions including the ruled line are 9 to 10, that is, smaller than the threshold value, and therefore, the unit regions are not set as positions where the driving pulse is to be changed for a print head 9. In this embodiment, correction is performed by weighting so that 100 times the count values of the unit regions including pixels having a ruled-line attribute are obtained. By this, the unit regions including the pixels having the ruled-line attribute may be appropriately determined. On the other hand, FIG. 10C is a diagram illustrating a weighting process to be performed so that the count values of the unit regions including pixels having a character attribute become zero. Here, 1 is set as a threshold value. In FIG. 10A, regions which are not hatched are determined to be regions in which count values obtained after the weighting process are equal to or larger than the threshold value whereas hatched regions are determined to be regions in which count values obtained after the weighting process are smaller than the threshold value.

As described above, since the weighting process is performed in accordance with properties of the pixels, an appropriate determination may be made even in unit regions having small count values, such as regions only including the ruled line. By this, driving power of the print head 9 for the regions is increased and degradation of quality of the ruled line may be suppressed.

Third Embodiment

In the foregoing embodiment, the ruled-line regions including the pixels having the ruled-line attribute are determined and control is performed so that the driving power of the print head 9 is increased. In a third embodiment, control is performed so that driving power is increased when, instead of all ruled line regions, a ruled line region to be printed by printing elements which are in a state in which condensation of ink progresses in portions in the vicinity of ejection ports is detected.

Specifically, a position where the driving pulse is to be changed is set in a ruled line region detected after regions having small count values representing ejection of ink are consecutively detected. For example, in a case where a region of interest includes pixels having a ruled-line attribute and count values of a predetermined number of consecutive unit regions scanned by a print head before the region of interest are smaller than a threshold value, a position where the driving pulse is to be changed is set.

Furthermore, this method is applicable to a case where a weighting process is performed on count values of regions including pixels having a ruled-line attribute. For example, in a case where a count value of a region of interest obtained after the weighting process is equal to or larger than a threshold value and count values of a predetermined number of consecutive unit regions scanned by the print head before the region of interest are smaller than the threshold value, a driving pulse changing portion is set. The term "a predetermined number of consecutive unit regions" corresponds to a shortest length which causes image defect as a result of progress of ink condensation in portions in the vicinity of nozzle ports during scanning of the print head.

With this configuration, a driving pulse may be controlled so that quality of a ruled line image printed after ink condensation progresses since ejection of ink is little is not degraded.

Fourth Embodiment

In a fourth embodiment, a driving pulse changing portion is set to a unit region which does not include pixels having a character attribute to be printed after a predetermined number of consecutive unit regions which include the pixels having the character attribute and which are arranged in a scanning direction.

Figure 11:
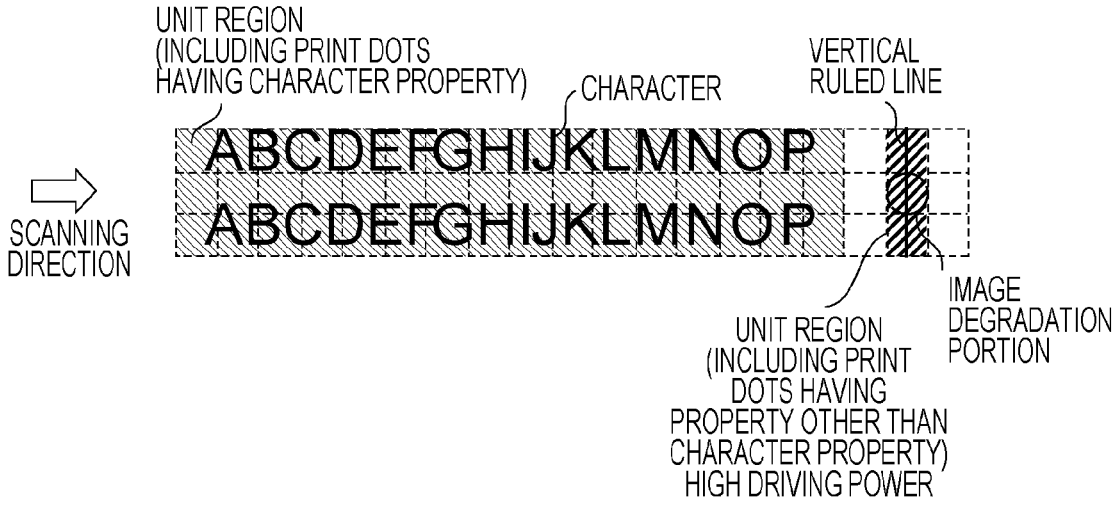
FIG. 11 is a diagram illustrating a driving pulse changing method based on attribute data according to a fourth embodiment.

In FIG. 11, hatched regions including alphabets and a space between character strings correspond to unit regions including the pixels having the character attribute. Assuming that 10 consecutive unit regions is a threshold value, since 10 or more unit regions are consecutively arranged in FIG. 11, a driving pulse changing portion is set to a unit region which does not include the pixels having the character attribute and which is detected after the consecutive unit regions.

In this embodiment, it is assumed that a predetermined number of consecutive print dots having the character attribute arranged in a scanning direction correspond to image data of alphabets, and since such a portion strides a plurality of lines in many cases, a space between lines exists. Furthermore, even when only one line is detected, blank areas exist in upper and lower portions of the line, and therefore, as with the case in which a space between lines exists, degradation of quality of a ruled line may occur. In this embodiment, detection of a driving pulse changing portion may be advantageously performed without counting print dots, and the detection is performed with ease in terms of hardware and software.

Other Embodiments

The first embodiment has the configuration in which a determination as to whether a pixel having a ruled-line attribute is included is made, and in addition, the first embodiment may have a configuration in which a determination as to whether each pixel has a ruled-line attribute is made in advance. In this case, the first embodiment may have a configuration in which a pixel including a thin line in which quality is likely to be degraded is determined as a pixel having a ruled-line attribute, pulse changing control is performed as described above on the pixel including a thin line but the pulse changing control is not performed on a pixel including a thick line in which degradation of quality is not likely to be visually recognized. Furthermore, the pulse changing control may be performed on a dotted line. For example, information representing width of a ruled line or information representing a type of line, such as a solid line or a dotted line, may be obtained and a determination as to whether a pixel has a ruled-line attribute may be made in accordance with the obtained information. With this configuration, control for changing a driving pulse may be appropriately performed, in particular, on lines in which degradation of quality is likely to be visually recognized.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-148766, filed Jul. 17, 2013, which is hereby incorporated by reference herein in its entirety.

What is claimed is:

1. A printing apparatus for printing an image on a printing medium using a plurality of printing elements for generating energy used for ejection of ink, the printing apparatus comprising:

a determination unit configured to determine whether a pixel having a ruled-line attribute is included in image data of the image; and a printing unit configured to print the image based on a result of the determination performed by the determination unit, wherein the energy to be applied by the printing elements to the ink for printing a region including the pixel having the ruled-line attribute is higher than energy to be applied by the printing elements to the ink for printing a region which does not include the pixel having the ruled-line attribute.

2. The printing apparatus according to claim 1, wherein a speed of ejection of ink from the printing elements to the region including the pixel having the ruled-line attribute is higher than a speed of ejection of ink from the printing elements to the region which does not include the pixel having the ruled-line attribute.

3. The printing apparatus according to claim 1, wherein each of first and second driving pulse has a main heating pulse and a pre-heating pulse, the first driving pulse being applied to the printing elements for printing the region including the pixel having the ruled-line attribute, and the second driving pulse being applied to the printing elements for printing the region which does not include the pixel having the ruled-line attribute.

4. The printing apparatus according to claim 3, wherein a period of time in which the pre-heating pulse included in the first driving pulse is applied is longer than a period of time in which the pre-heating pulse included in the second driving pulse is applied.

5. The printing apparatus according to claim 4, wherein a halt time between the main heating pulse and the pre-heating pulse included in the first driving pulse is longer than a halt time between the main heating pulse and the pre-heating pulse included in the second driving pulse.

6. The printing apparatus according to claim 1, wherein a driving voltage of the first driving pulse applied to the printing elements for printing the region including the pixel having the ruled-line attribute is lower than a driving voltage of the second driving pulse applied to the printing elements for printing the region which does not include the pixel having the ruled-line attribute.

7. A printing apparatus for printing an image on a printing medium using printing elements for generating energy used for ejection of ink, the printing apparatus comprising:

a determination unit configured to determine whether a pixel having a ruled-line attribute is included in each of a plurality of unit regions in which the image is printed;

an obtaining unit configured to obtain count numbers representing the numbers of ejected ink droplets in the individual unit regions;

a correction unit configured to correct the count numbers of unit regions determined to include the pixel having the ruled-line attribute so as to obtain values equal to or larger than a predetermined threshold value; and a printing unit configured to print the image in accordance with the values corrected by the correction unit, wherein energy generated by the printing elements for printing the unit regions having the count numbers equal to or larger than the predetermined threshold value is higher than energy generated by the printing elements for printing the unit regions having the count numbers smaller than the threshold value.

8. A printing apparatus for printing an image on a printing medium by performing scanning using a print head including a plurality of printing elements for generating energy used for ejection of ink, the printing apparatus comprising:

a first determination unit configured to determine whether a pixel having a ruled-line attribute is included in each of a plurality of unit regions aligned in a direction of the scanning;

an obtaining unit configured to obtain count numbers representing the numbers of ejected ink droplets in the individual unit regions;

a second determination unit configured to determine whether the count values are smaller than a predetermined threshold value for individual unit regions; and a printing unit configured to print the image in accordance with a result of the determination performed by the first determination unit and a result of the determination performed by the second determination unit, wherein a region of interest scanned by the print head after at least a predetermined number of consecutive unit regions having the count numbers smaller than the predetermined threshold value are detected is set, and energy generated by the printing elements used to eject ink to the region of interest when the region of interest includes a pixel having a ruled-line attribute is higher than energy generated by the printing elements used to eject ink to the region of interest when the region of interest does not include the pixel having the ruled-line attribute.

9. A printing apparatus for printing an image on a printing medium by performing scanning using a print head including a plurality of printing elements for generating energy used for ejection of ink, the printing apparatus comprising:

a first determination unit configured to determine whether a pixel having a ruled-line attribute is included in each of a plurality of unit regions aligned in a direction of the scanning;

an obtaining unit configured to obtain count numbers representing the numbers of ejected ink droplets in the individual unit regions;

a correction unit configured to correct the count numbers obtained by the obtaining unit of the unit regions determined by the first determination unit to include the pixel having the ruled-line attribute so that values equal to or larger than a predetermined threshold value are obtained;

a second determination unit configured to determine whether the count numbers of the individual unit regions are smaller than the predetermined threshold value after the correction performed by the correction unit; and a printing unit configured to print the image in accordance with a result of the determination performed by the first determination unit and a result of the determination performed by the second determination unit, wherein energy generated by the printing elements used to eject ink to the region of interest when the count number of the region of interest which is scanned by the print head after at least a predetermined number of consecutive unit regions having the count numbers smaller than the predetermined threshold value are detected is equal to or larger than the predetermined threshold value is higher than energy generated by the printing elements used to eject ink to the region of interest when the count number of the region of interest is smaller than the predetermined threshold value.

10. A printing method for printing an image on a printing medium using printing elements for generating energy used to eject ink, the printing method comprising:

determining whether a pixel having a ruled-line attribute is included in image data of the image to be printed on the printing medium; and printing the image in accordance with a result of the determination, wherein the energy to be applied by the printing elements to the ink for printing a region including the pixel having the ruled-line attribute is higher than energy to be applied by the printing elements to the ink for printing a region which does not include the pixel having the ruled-line attribute.

* * * * *